US005882793A

United States Patent [19]

Shida et al.

[11] Patent Number: 5,882,793

[45] Date of Patent: Mar. 16, 1999

[54] ORIENTED POLYAMIDE FIBER AND PROCESS FOR PRODUCING SAME

[75] Inventors: Takatoshi Shida; Makoto Takahashi; Masahiro Harada, all of Hiratsuka, Japan

[73] Assignee: Mitsubishi Gas Chemical Company, Inc., Tokyo, Japan

[21] Appl. No.: 762,100

[22] Filed: Dec. 9, 1996

[30] Foreign Application Priority Data

Dec. 26, 1995 [JP] Japan ..... 7-338981

[51] Int. Cl.[6] ..... B02G 3/00; B29C 47/06

[52] U.S. Cl. ..... 428/393; 428/364; 264/172.18

[58] Field of Search ..... 428/364, 374, 428/395; 528/310, 322, 335, 336, 347, 432; 264/172.18

[56] References Cited

U.S. PATENT DOCUMENTS

| | | | |
|---|---|---|---|
| 3,624,565 | 11/1971 | Ogata et al. | 428/374 |
| 3,629,053 | 12/1971 | Kimura | 428/374 |
| 3,968,071 | 7/1976 | Miyamoto . | |
| 4,128,599 | 12/1978 | Thomas et al. | 260/857 R |
| 4,337,179 | 6/1982 | Uejo et al. | 252/511 |
| 4,339,555 | 7/1982 | Ohmura et al. | 525/66 |
| 4,849,476 | 7/1989 | Mashita et al. | 525/183 |
| 4,921,932 | 5/1990 | Tumura et al. | 528/339.3 |
| 5,349,044 | 9/1994 | Liu et al. | 528/310 |
| 5,587,447 | 12/1996 | Harada et al. | 528/347 |

FOREIGN PATENT DOCUMENTS 475 720 3/1992 European Pat. Off. .

OTHER PUBLICATIONS

Derwent Publications Ltd., London GB, AN 94–364092, Oct. 11, 1994 of JP 6287807, Mitsubishi Gas Chem. Co.

*Primary Examiner*—Newton Edwards
*Attorney, Agent, or Firm*—Frishauf, Holtz, Goodman, Langer & Chick, P.C.

[57] ABSTRACT

There are disclosed oriented polyamide fiber which comprises at least 20% by weight of a crystalline polyamide or a copolymerized polyamide each produced by polymerizing a monomer containing m-xylylenediamine as a diamine component and adipic acid as a dicarboxylic acid component each in an amount of at least 70 mol % (A) and which has a Young's modulus of at least 400 kgf/mm$^2$, a loop strength of at least 4.5 gf/D, a knot tensile strength of at least 3.5 gf/D and a roundness of from 97 to 100%; and a process for producing oriented polyamide fiber which comprises the steps of melting a polyamide resin comprising at least 20% by weight of the above crystalline polyamide or copolymerized polyamide (A); spinning the molten resin through a spinneret; pulling the spun product into a coolant bath placed beneath the face of the spinneret to produce non-oriented yarn; and thereafter orienting the non-oriented yarn to a draw ratio of from 2.5. to 8.0 at a temperature not lower than the Tg of the polyamide and not higher than the melting point thereof, wherein the draft ratio is from 1.0 to 3.0, and the temperature of the coolant bath (T) satisfies the relational expression: $Tg-30 \leqq T \leqq Tg+10$ (°C.). The oriented polyamide fiber is useful for use in sporting goods and industrial materials such as strings for a racket, rubber reinforcing materials and filter cloth materials for paper making by virtue of its improvement in strength, modulus of elasticity and roundness.

15 Claims, No Drawings

ORIENTED POLYAMIDE FIBER AND PROCESS FOR PRODUCING SAME

BACKGROUND OF THE INVENTION

1. Field of the Invention

The present invention relates to oriented polyamide fiber which has a high strength, modulus of elasticity and roundness and which is useful for use in sporting goods such as strings for a racket, in industrial materials such as a rubber reinforcing material and a filter cloth material for paper making and so forth; and a process for producing said polyamide fiber.

2. Description of the Related Arts

Polyamide fiber is generally employed in sporting goods such as strings for a racket, in industrial materials such as a rubber reinforcing material and a filter cloth material for paper making and so forth. In the above-mentioned purposes of use, the polyamide fiber as the construction material is required to be imparted with sufficient modulus of elasticity, that is, Young's modulus and also sufficient mechanical strength including loop strength and knot tensile strength. Moreover in said purposes of use, the polyamide fiber is required to be high in its roundness in the case where a final product made from the fiber is put into practical use, or in the case of secondary processing.

Specifically, when the polyamide fiber is low in its roundness, it will bring about such problems that it is hard to pass the fiber through a clearance or an opening of an accurately processed article, thus lowering the adaptability thereof to machinery and equipment for secondary processing and that the shape of its product after secondary processing is not uniformized.

A polyamide having repeated units of amide bond which is obtained from m-xylylenediamine and an aliphatic dicarboxylic acid (for example, a polyamide obtained from m-xylylenediamine and adipic acid, hereinafter sometimes referred to as "polyamide MXD6") is expected to find applications in the above-mentioned purpose of use, since it is characterized by its high strength, high Young's modulus and the like as compared with the conventional polyamide 6 and polyamide 66. However, the polyamide MXD6 fiber having high roundness can not be produced with conventional spinning methods, which becomes an obstacle to its practical application.

In more detail, a melt spinning method is usually applied to the production of the polyamide fiber which is employed in sporting goods such as strings for a racket, in industrial materials such as a rubber reinforcing material and a filter cloth material for paper making and so forth. Specifically there is adopted to the production, a spinning method in which a polyamide resin is molten with a single-screw or twin-screw extruder, the molten resin is spun through a spinneret, the spun product is pulled in a coolant bath placed beneath the face of the spinneret to produce non-oriented yarn, and thereafter the non-oriented yarn is oriented. For example, in the case of polyamide 6 or polyamide 66, by the use of non-oriented yarn in which crystallization is suppressed by setting the temperature of a coolant bath lower than the glass transition temperature (Tg) of the polyamide by at least 30° C., it is facilitated to carry out orientation procedures while preserving the roundness of the non-oriented yarn, whereby the roundness of the yarn is enhanced. The above-mentioned method is exclusively adopted for the purpose of enhancing the roundness of yarn.

On the other hand, in the case of a polyamide containing polyamide MXD6, the Tg of the polyamide MXD6 is remarkably high as compared with that of polyamide 6 or polyamide 66. Therefore, solidification of the non-oriented yarn due to quenching rapidly takes place at a cooling temperation in the conventional melt spinning method for polyamide and at the same time, the resistance in a cooling vessel between the non-oriented yarn and the coolant, and the vibration of the yarn at the time of pulling the yarn in the bath bring about yarn swinging because of the high modulus of elasticity inherent to the polyamide MXD6, whereby the yarn swinging is likely to be transferred to the molten portion of the yarn with a lower strength thus causing a decrease in yarn roundness as well as diametral unevenness of yarn. For this reason, it has heretofore been extremely difficult to steadily and continuously produce a polyamide-MXD6-containing polyamide yarn with high roundness.

SUMMARY OF THE INVENTION

The present invention has been accomplished under the above-described circumstances. Specifically, the object of the present invention is to provide oriented polyamide fiber which has a high strength, modulus of elasticity and roundness and contains polyamide MXD6, and also a process capable of steadily and continuously producing the same through a conventional melt spinning method.

As a result of intensive research and investigation made by the present inventors for the purpose of achieving the aforestated object, it has been found that the above-mentioned problems are solved by carrying out the melt spinning under specific conditions. The present invention has been completed on the basis of such finding.

Specifically, the present invention provides an (1) an oriented polyamide fiber which comprises at least 20% by weight of a crystalline polyamide or a copolymerized polyamide each produced by polymerizing a monomer containing m-xylylenediamine as a diamine component and adipic acid as a dicarboxylic acid component each in an amount of at least 70 mol % (A) and which has a Young's modulus of at least 400 kgf/mm$^2$, a loop strength of at least 4.5 gf/D, a knot tensile strength of at least 3.5 gf/D and a roundness in the range of from 97 to 100%;

(2) the oriented polyamide fiber as set forth in the preceding item (1) which further comprises at most 80% by weight of a (B) crystalline polyamide other than the polyamide (A);

(3) a process for producing an oriented polyamide fiber which comprises the steps of melting a polyamide resin comprising at least 20% by weight of a crystalline polyamide or a copolymerized polyamide each produced by polymerizing a monomer containing m-xylylenediamine as a diamine component and adipic acid as a dicarboxylic acid component each in an amount of at least 70 mol % (A) by the use of a single-screw or twin-screw extruder; spinning the molten resin through a spinneret; pulling the spun product into a coolant bath placed beneath the face of the spinneret to produce non-oriented yarn; and thereafter orienting the non-oriented yarn to a draw ratio of from 2.5 to 8.0 under the temperature conditions of not lower than the glass transition temperature (Tg) of said polyamide and not higher than the melting point thereof, wherein the ratio of the cross-sectional area of the spinneret for a spinning machine (AD) to the cross-sectional area of the non-oriented yarn formed by cooling the product spun by and discharged from the spinning machine in a coolant bath (AM), (AD/AM) (hereinafter referred to as "draft ratio") is in the range of from 1.0 to 3.0, and the temperature of the coolant bath into which the yarn spun by and discharged from the spinning machine is pulled via an air layer made to intervene between a discharge port of the molten resin for the spinning machine and the surface of the coolant bath for cooling the molten resin (T) is in the range satisfying the relational expression $$Tg-30 \leqq T \leqq Tg+10 \text{ (°C.); and}$$

(4) the process for producing an oriented polyamide fiber as set forth in the preceding item (3) wherein said polyamide resin comprising at least 20% by weight of a polyamide (A) further comprises at most 80% by weight of a (B) crystalline polyamide other than the crystalline polyamide (A).

DESCRIPTION OF THE PREFERRED EMBODIMENTS

The polyamide (A) to be used in the present invention is a crystalline polyamide or a copolymerized polyamide each produced by polymerizing a monomer containing m-xylylenediamine as a diamine component and adipic acid as a dicarboxylic acid each in an amount of at least 70 mol %.

In the case where the polyamide (A) is produced by polymerizing a monomer containing m-xylylenediamine as a diamine component and adipic acid as a dicarboxylic acid each in an amount of less than 70 mol %, the polyamide fiber finally formed therefrom is deprived of its characteristics such as high strength and high Young's modulus.

The oriented polyamide to be used in the present invention may contain a (B) crystalline polyamide other than the polyamide (A). A variety of polyamides are available as the polyamide (B) other than the polyamide (A) and are specifically exemplified by polyamide 6, polyamide 66, polyamide 6/66 (a copolymer of polyamide 6 component and polyamide 66 component), polyamide 610, polyamide 612, polyamide 11, polyamide 12 and a mixture thereof. Of these, are preferably usable polyamide 6, polyamide 66 and polyamide 6/66 in the present invention. By the use of any of the above-exemplified polyamide resin it is made easy to regulate the physical properties of the objective fiber such as strength and elongation percentage by adjusting the conditions at the time of melt extrusion.

It is necessary that the oriented polyamide fiber according to the present invention contains at least 20% by weight of the aforestated polyamide (A). In the case where the blending proportion of the polyamide (A) in the fiber is less than 20% by weight, it is made difficult that the characteristics inherent in polyamide MXD6 such as high strength, high modulus of elasticity and crystallization rate facilitating the spinning be reflected upon the physical properties of the objective polyamide fiber. It is also preferable that the blending proportion of the crystalline polyamide (B) be at most 80% by weight.

The oriented polyamide fiber according to the present invention has a Young's modulus of at least 400 kgf/mm$^2$, preferably at least 500 kgf/mm$^2$. In the case where the oriented polyamide fiber having a Young's modulus of less than 400 kgf/mm$^2$ is used for strings for a racket, a rubber reinforcing material or a filter cloth material for paper making, deformation takes place, thus depriving the fiber product of commodity value.

In addition, the oriented polyamide fiber according to the present invention has a loop strength of at least 4.5 gf/D, preferably at least 5.0 gf/D. In the case where the oriented polyamide fiber having a loop strength of less than 4.5 gf/D is used for strings for a racket, breaking of the strings takes place at the bending portion thereof at the time of being attached to the racket, thus depriving the fiber product of commodity value; and besides when it is used for a filter cloth material for paper making, since the filter cloth material is attached to a roll for a paper machine by a method wherein part of filter cloth fiber is bent and the filter cloth material is connected to the roll by passing core threads through the resultant bending part, breaking of the cloth material takes place at the connecting portion, thereby depriving the filter cloth of commodity value.

Moreover, the oriented polyamide fiber according to the present invention has a knot tensile strength of at least 3.5 gf/D, preferably at least 4.0 gf/D. In the case where the oriented polyamide fiber having a knot tensile strength of less than 3.5 gf/D is used for strings for a racket, breaking of the strings takes place at the knots thereof at the time of being mounted on the racket, whereby the commodity value of the strings is lost.

The present invention also relates to a process for producing oriented polyamide fiber which comprises the steps of melting a polyamide resin comprising at least 20% by weight of a crystalline polyamide or a copolymerized polyamide each produced by polymerizing a monomer containing m-xylylenediamine as a diamine component and adipic acid as a dicarboxylic acid component each in an amount of at least 70 mol % (A) by the use of a single-screw or twin-screw extruder; spinning the molten resin through a spinneret; pulling the spun product into a coolant bath placed beneath the face of the spinneret to produce non-oriented yarn; and thereafter orienting the non-oriented yarn to a draw ratio of from 2.5 to 8.0 under the temperature conditions of not lower than Tg of said polyamide and not higher than the melting point thereof.

In particular, with regard to the process according to the present invention, the draft ratio, that is, the ratio of the cross-sectional area of the spinneret for a spinning machine (AD) to the cross-sectional area of the non-oriented yarn formed by cooling the product spun by and discharged from the machine in a coolant bath (AM), (AD/AM) is 1.0 to 3.0, preferably 1.0 to 2.5. A draft ratio of less than 1.0 in the aforesaid process makes it difficult to actually produce non-oriented yarn, whereas that of more than 3.0 makes it difficult to produce polyamide fiber having high roundness, since the influence of the extruding and cooling conditions exerted upon the non-oriented yarn is amplified. In the process according to the present invention, the AM, that is, the cross-sectional area of the non-oriented yarn formed by cooling the product spun by and discharged from the machine in a coolant bath is specified by the following formula $$AM(\text{cm}^2)=G/(L\times\rho)$$

wherein G stands for the weight in g of the non-oriented yarn having a density of ρ in g/cm$^2$ and a length of L in cm.

It is necessary in the process according to the present invention to make an air layer intervene between a discharge port of the molten resin for the spinning machine and the surface of the coolant bath for cooling the molten resin for the purpose of preventing the yarn from being quenched. Nonexistence of an air layer therebetween brings about such troubles as yarn swinging due to coolant boiling at the time when the molten resin is brought into contact with the coolant and the generation of vacuum foams due to quenched yarn.

In view of the foregoing, it is preferable that the thickness of the aforesaid air layer, namely the distance between the discharge port of the molten resin for the spinning machine and the surface of the coolant bath for cooling the molten resin (hereinafter referred to as "air gap") be at least 10 mm from the preactical point of view. The air layer, when being unreasonably thick, will make it difficult to produce polyamide fiber having high roundness because of the drawdown, etc. of the molten resin. For this reason, the air gap is preferably 150 mm or less from the practical viewpoint. In the process of the present invention, the air gap is more preferably from 10 to 110 mm.

It is required, in the process according to the present invention that the temperature of the coolant bath (T) into which the polyamide yarn discharged from the spinning machine is pulled be in the temperature range satisfying the relational expression $$Tg-30 \leqq T \leqq Tg+10 \ (°C.)$$

which specifies the relationship between Tg of the polyamide resin and T. The temperature of the coolant bath (coolant temperature), when being lower than Tg−30 (°C.), will give rise to trouble such as the generation of voids due to the difference in temperature between the surface of the non-oriented yarn and the inside thereof or due to the yarn quenching. On the other hand, the temperature thereof, when being higher than Tg+10 (°C.), will bring about such troubles as the collapse of the non-oriented yarn due to insufficient cooling and difficulty in orientation due to the crystallization of the non-oriented yarn.

In the case of using a material formed by blending a plurality (N) of polyamide resins, Tg of the resultant blend to be adopted in the present invention is defined by the formula $$Tg(°C.)=a\times TgA+b\times TgB+c\times TgC+\ldots+nTgN$$

wherein a, b, c, . . . n each stand for the volumetric fraction of the component A, B, C, . . . N, and TgA, TgB, TgC, . . . TgN each represent Tg of the component A, B, C, . . . N.

In the process according to the present invention, it is made possible to produce polyamide fiber having high roundness by setting the coolant temperature at a higher level than that of the conventional general spinning conditions and also to dispense with a coolant cooler which has heretofore been necessary.

The crystalline polyamide or a copolymerized polyamide each produced by polymerizing a monomer containing m-xylylenediamine as a diamine component and adipic acid as a dicarboxylic acid component each in an amount of at least 70 mol % (A) which polyamide is used in the production process according to the present invention, is the same as the polyamide which is contained in the oriented polyamide fiber according to the present invention. The single-screw or twin-screw extruder to be used for melt spinning in the process of the invention can be optionally selected for use from a variety of extruders for conventional application. Mixing of the polyamide (A) and the crystalline polyamide other than (A), (B) to be used in the present invention can be carried out by any of a method generally referred to as "dry blending method" in which, for example, solid materials such as pellet as such are fed in an extruder under mixing, and a method generally referred to as "melt blending method" in which solid materials are once melt extruded together to pelletize the same and the resultant pellet is used as the starting raw material. As described hereinbefore, the present invention is concerned with a process for producing oriented polyamide fiber oriented to a draft ratio of from 2.5 to 8.0 at a temperature not lower than Tg of the polyamide resin and not higher than the melting point thereof.

Likewise, the present invention pertains to oriented polyamide fiber having a roundness in the range of from 97 to 100% and a process for producing the same. The value of roundness (%) is defined by the following formula, and the closer the value to 100%, the closer the cross-sectional shape of a filament to a true circle.

$$\text{Roundness } \% = (1/n) \sum_{i=1}^{n} [(RSi/RMi) \times 100]$$

wherein RSi (mm) is the smallest fiber diameter at the i'th point among the measuring points of n numbers, and RMi (mm) is the median fiber diameter at the i'th point among the measuring points of n numbers.

In the case where the roundness of the polyamide fiber is less than 97%, a definite shape is not obtained, for example, in the multi-layer structural yarns such as modern tennis gut and woven or nonwoven fabric such as a filter cloth material for paper making, thus causing the loss of their commodity values; and besides, there are brought about such troubles as difficulty in passing the yarn through a clearance or an opening of a precisely processed article, and low adaptability to machinery and equipment for secondary processing.

It is possible according to the present invention to produce oriented polyamide fiber having a diameter after final orientation of 0.05 to 2 mm, preferably 0.1 to 1.5 mm.

The polyamide resin to be used in the present invention may be incorporated as necessary with an inorganic or organic compound such as thermal-age resister, color preventive agent, crosslinking preventive agent, weatherability improver, ultraviolet absorber, pigment, antistatic agent and flame retardant, each alone or in optional combination with one another.

The usable coolant in the process according to the present invention is exemplified by water, glycerol, liquid paraffin, silicone oil, hydrocarbon series oil, polyethylene glycol and diethylene glycol.

The oriented polyamide fiber obtained through the present invention is useful for use in sporting goods such as strings for a racket and in industrial materials such as a rubber reinforcing material and a filter cloth material for paper making and so forth by virtue of its high strength, modulus of elasticity and roundness.

In the following, the present invention will be described in more detail with reference to comparative examples and working examples, which however, shall not restrict the present invention thereto. Measurements were made of the strength and Young's modulus of the oriented yarn according to JIS L 1013 "Testing method for chemically synthesized filament yarns", and of the diameter of the oriented yarn by measuring a smallest diameter and a largest diameter at 100 numbers of arbitrary points with a spacing of 10 cm each.

In the Tables 1, 2 and 3, polyamide MXD6 is abbreviated to N-MXD6.

EXAMPLE 1

Polyamide MXD6 (Relative viscosity: 2.7, produced by Mitsubishi Gas Chemical Co., Inc. under the trade name "6007") was molten by the use of a single-screw extruder, spun through a spinneret at a spinning temperature of 260° C., pulled into a water bath at 70° C. under the conditions including a draft ratio of 1.1 and an air gap of 100 mm, and continuously oriented without temporary winding.

The orientation was put into practice by two stages of orientation and single stage of heat setting. There were used as orientation means, a warm water bath at 90° C. in the first stage orientation region, a dry hot air bath at 220° C. in the second-stage orientation region and a dry hot air bath at 280° C. in the heat setting region. As the orientation conditions, the overall draw ratio, the second stage draw ratio and the relaxation ratio were set on 5.0, 1.2 and 5%, respectively. By the above-mentioned procedures, there was produced polyamide single yarn at a production velocity of 48 m/min. The yarn diameter and roundness of the polyamide yarn thus obtained are given in Table 1.

EXAMPLE 2

Polyamide MXD6 same as that used in Example 1 was molten by the use of a single-screw extruder, spun through a spinneret at a spinning temperature of 260° C., pulled into a water bath at 90° C. under the conditions including a draft ratio of 2.3 and an air gap of 100 mm, and continuously oriented without temporary winding.

The orientation was put into practice by two stages of orientation and single stage of heat setting. There were used as orientation means, a warm water bath at 90° C. in the first stage orientation region, a dry hot air bath at 240° C. in the second stage orientation region and a dry hot air bath at 280° C. in the heat setting region. As the orientation conditions, the overall draw ratio, the second stage draw ratio and the relaxation ratio were set on 5.2, 1.2 and 5%, respectively. By the above-mentioned procedures, there was produced polyamide single yarn at a production velocity of 75 m/min. The yarn diameter and roundness of the polyamide yarn thus obtained are given in Table 1.

EXAMPLE 3

Polyamide MXD6 same as that used in Example 1 and polyamide 6 (Relative viscosity: 2.3, produced by Ube Industries, Ltd under the trade name "1011FB") were dry blended in a ratio by weight of 80/20 and melt spun through a spinneret at a spinning temperature of 260° C., pulled into a water bath at 70° C. under the conditions including a draft ratio of 2.3 and an air gap of 100 mm, and continuously oriented without temporary winding.

The orientation was put into practice in the same manner as in Example 2 to produce polyamide single yarn. The yarn diameter and roundness of the polyamide yarn thus obtained are given in Table 1.

EXAMPLE 4

Polyamide MXD6 same as that used in Example 1 and polyamide 6 were dry blended in a ratio by weight of 30/70 and melt spun through a spinneret at a spinning temperature of 240° C., pulled into a water bath at 30° C. under the conditions including a draft ratio of 2.5 and an air gap of 100 mm, and continously oriented without temporary winding.

As the orientation conditions, the overall draw ratio, the second stage draw ratio and the relaxation ratio were set on 5.1, 1.5 and 10%, respectively. By the above-mentioned procedures, there was produced polyamide single yarn at a production velocity of 78 m/min. The yarn diameter and roundness of the polyamide yarn thus obtained are given in Table 1.

EXAMPLE 5

Polyamide MXD6 same as that used in Example 3 and polyamide 6 were dry blended in a ratio by weight of 30/70 and melt spun through a spinneret at a spinning temperature of 240° C., pulled into a water bath at 30° C. under the conditions including a draft ratio of 2.5 and an air gap of 10 mm, and continuously oriented without temporary winding.

The orientation was put into practice in the same manner as in Example 4 to produce polyamide single yarn. The yarn diameter and roundness of the polyamide yarn thus obtained are given in Table 1.

EXAMPLE 6

Polyamide MXD6 same as that used in Example 3 and polyamide 6 were dry blended in a ratio by weight of 20/80 and melt spun through a spinneret at a spinning temperature of 240° C., pulled into a water bath at 30° C. under the conditions including a draft ratio of 2.7 and an air gap of 100 mm, and continuously oriented without temporary winding.

The orientation was put into practice in the same manner as in Example 4 to produce polyamide single yarn. The yarn diameter and roundness of the polyamdie yarn thus obtained are given in Table 1.

EXAMPLE 7

Polyamide MXD6 same as that used in Example 3 and polyamide 66 (produced by Ube Industries, Ltd under the trade name "2015B") were dry blended in a ratio by weight of 95/5 and melt spun. Thereafter the procedure in Example 2 was repeated to produce polyamide single yarn. The yarn diameter and roundness of the polyamide yarn thus obtained are given in Table 1.

EXAMPLE 8

Polyamide MXD6 same as that used in Example 7 and polyamide 66 were dry blended in a ratio by weight of 80/20 and melt spun. Thereafter the procedure in Example 3 was repeated to produce polyamide single yarn. The yarn diameter and roundness of the polyamide yarn thus obtained are given in Table 1.

COMPARATIVE EXAMPLE 1

Polyamide MXD6 same as that used in Example 3 and polyamide 6 were dry blended in a ratio by weight of 10/90 and molten by the use of a single-screw extruder, spun through a spinneret at a spinning temperature of 260° C., pulled into a water bath at 6.5° C. under the conditions including a draft ratio of 2.7 and an air gap of 10 mm, and continuously oriented without temporary winding.

The orientation was put into practice in the same manner as in Example 4 to produce polyamide single yarn. The yarn diameter and roundness of the polyamide yarn thus obtained are given in Table 1.

COMPARATIVE EXAMPLE 2

Polyamide MXD6 same as that used in Example 3 and polyamide 6 were dry blended in a ratio by weight of 30/70 and molten by the use of a single-screw extruder, spun through a spinneret at a spinning temperature of 260° C., pulled into a water bath at 5° C. under the conditions including a draft ratio of 2.5 and an air gap of 100 mm, and continuously oriented without temporary winding.

The orientation was put into practice in the same manner as in Example 4 to produce polyamide single yarn. The yarn diameter and roundness of the polyamide yarn thus obtained are given in Table 1.

COMPARATIVE EXAMPLE 3

Polyamide MXD6 same as that used in Example 3 and polyamide 6 were dry blended in a ratio by weight of 30/70 and molten by the use of a single-screw extruder, spun through a spinneret at a spinning temperature of 260° C., pulled into a water bath at 30° C. under the conditions including a draft ratio of 4.0 and an air gap of 100 mm, and continuously oriented without temporary winding.

The orientation was put into practice in the same manner as in Example 4 to produce polyamide single yarn. The yarn diameter and roundness of the polyamide yarn thus obtained are given in Table 1.

COMPARATIVE EXAMPLE 4

Polyamide MXD6 same as that used in Example 7 and polyamide 66 were dry blended in a ratio by weight of 80/20 and molten by the use of a single-screw extruder, spun through a spinneret at a spinning temperature of 260° C., pulled into a water bath at 70° C. under the conditions including a draft ratio of 4.0 and an air gap of 100 mm, and continuously oriented without temporary winding.

The orientation was put into practice in the same manner as in Example 2 to produce polyamide single yarn. The yarn diameter and roundness of the polyamide yarn thus obtained are given in Table 1.

TABLE 1-1

| Number of example | Example 1 | Example 2 | Example 3 |
|---|---|---|---|
| Resin used | N-MXD6 | N-MXD6 | N-MXD6/N-6 |
| Blending proportion | — | — | 80/20 |
| Tg (°C.) | 85 | 85 | 77 |
| Draft ratio | 1.1 | 2.3 | 2.4 |
| Air gap (mm) | 100 | 100 | 100 |
| Coolant temperature (°C.) | 70 | 90 | 70 |
| Draw ratio | 5.0 | 5.2 | 5.2 |
| Diameter of oriented yarn (mm) | | | |
| Minimum small diameter | 1.11 | 0.87 | 0.86 |
| Maximum large diameter | 1.13 | 0.90 | 0.87 |
| Median yarn diameter | 1.12 | 0.89 | 0.87 |
| Roundness (%) | 99.1 | 98.3 | 99.3 |
| Young's modulus (kgf/mm$^2$) | 740 | 840 | 760 |
| Tensile strength (gf/D) | 6.2 | 6.0 | 6.0 |
| Knot tensile strength (gf/D) | 4.1 | 4.4 | 4.5 |
| Loop strength (gf/D) | 4.9 | 5.0 | 8.4 |

TABLE 1-2

| Number of example | Example 4 | Example 5 | Example 6 |
|---|---|---|---|
| Resin used | N-MXD6/N-6 | N-MXD6/N-6 | N-MXD6/N-6 |
| Blending proportion | 30/70 | 30/70 | 20/80 |
| Tg (°C.) | 58 | 58 | 55 |
| Draft ratio | 2.5 | 2.5 | 2.7 |
| Air gap (mm) | 100 | 10 | 100 |
| Coolant temperature (°C.) | 30 | 30 | 30 |
| Draw ratio | 5.1 | 5.1 | 5.1 |
| Diameter of oriented yarn (mm) | | | |
| Minimum small diameter | 0.43 | 0.42 | 0.47 |
| Maximum large diameter | 0.44 | 0.44 | 0.48 |
| Median yarn diameter | 0.44 | 0.43 | 0.48 |
| Roundness (%) | 98.4 | 97.7 | 99.2 |
| Young's modulus (kgf/mm$^2$) | 540 | 540 | 450 |
| Tensile strength (gf/D) | 6.8 | 6.7 | 6.9 |
| Knot tensile strength (gf/D) | 7.6 | 4.8 | 3.8 |
| Loop strength (gf/D) | 10.7 | 5.8 | 5.8 |

TABLE 1-3

| Number of example | Example 7 | Example 8 |
|---|---|---|
| Resin used | N-MXD6/N-66 | N-MXD6/N-66 |
| Blending proportion | 95/5 | 80/20 |
| Tg (°C.) | 83 | 78 |
| Draft ratio | 2.3 | 2.3 |
| Air gap (mm) | 100 | 100 |
| Coolant temperature (°C.) | 90 | 70 |
| Draw ratio | 5.2 | 5.2 |
| Diameter of oriented yarn (mm) | | |
| Minimum small diameter | 0.86 | 0.86 |
| Maximum large diameter | 0.88 | 0.87 |
| Median yarn diameter | 0.87 | 0.87 |
| Roundness (%) | 98.9 | 99.0 |
| Young's modulus (kgf/mm$^2$) | 760 | 710 |
| Tensile strength (gf/D) | 6.3 | 6.0 |
| Knot tensile strength (gf/D) | 4.1 | 4.4 |
| Loop strength (gf/D) | 5.0 | 7.2 |

TABLE 1-4

| Number of example | Comparative Example 1 | Comparative Example 2 | Comparative Example 3 |
|---|---|---|---|
| Resin used | N-MXD6/N-6 | N-MXD6/N-6 | N-MXD6/N-6 |
| Blending proportion | 10/90 | 30/70 | 30/70 |
| Tg (°C.) | 51 | 58 | 58 |
| Draft ratio | 2.7 | 2.5 | 4.0 |
| Air gap (mm) | 10 | 100 | 100 |
| Coolant temperature (°C.) | 6.5 | 5 | 30 |
| Draw ratio | 5.1 | 5.1 | 5.1 |
| Diameter of oriented yarn (mm) | | | |
| Minimum small diameter | 0.42 | 0.44 | 0.38 |
| Maximum large diameter | 0.44 | 0.53 | 0.46 |
| Median yarn diameter | 0.43 | 0.48 | 0.42 |
| Roundness (%) | 97.7 | 90.5 | 90.3 |
| Young's modulus (kgf/mm$^2$) | 260 | 540 | 560 |
| Tensile strength (gf/D) | 7.4 | 7.5 | 6.2 |
| Knot tensile strength (gf/D) | 3.8 | 4.6 | 3.3 |
| Loop strength (gf/D) | 4.9 | 3.4 | 3.9 |

TABLE 1-5

| Number of example | Comparative Example 4 |
|---|---|
| Resin used | N-MXD6/N-66 |
| Blending proportion | 80/20 |
| Tg (°C.) | 78 |
| Draft ratio | 4.0 |
| Air gap (mm) | 100 |
| Coolant temperature (°C.) | 70 |
| Draw ratio | 5.2 |
| Diameter of oriented yarn (mm) | |
| Minimum small diameter | 0.80 |
| Maximum large diameter | 0.96 |
| Median yarn diameter | 0.88 |
| Roundness (%) | 90.9 |
| Young's modulus (kgf/mm$^2$) | 710 |
| Tensile strength (gf/D) | 6.3 |
| Knot tensile strength (gf/D) | 3.5 |
| Loop strength (gf/D) | 3.1 |

What is claimed is:

1. An oriented polyamide fiber which comprises a crystalline polyamide (A) produced by polymerizing a diamine with a dicarboxylic acid, said diamine consisting essentially of m-xylylenediamine, and said dicarboxylic acid consisting essentially of adipic acid, said oriented polyamide fiber having a Young's modulus of at least 400 kgf/mm$^2$, a loop strength of at least 4.5 gf/D, a knot tensile strength of at least 3.5 gf/D and a roundness in the range of from 97 to 100%.

2. The oriented polyamide fiber according to claim 1 which further comprises at most 80% by weight of a crystalline polyamide (B) which is other than the crystalline polyamide (A), the crystalline polyamide (B) being selected from the group consisting of polyamide 6; polyamide 66; a copolymer of polyamide 6 and polyamide 66; polyamide 610; polyamide 612; polyamide 11; polyamide 12 and mixtures thereof.

3. The oriented polyamide fiber according to claim 2 wherein the crystalline polyamide (B) is at least one member selected from the group consisting of polyamide 6, polyamide 66 and a copolymer of polyamide 6 component and polyamide 66 component.

4. A process for producing the oriented polyamide fiber according to claim 1 having a Young's modulus of at least 400 kgf/mm$^2$, a loop strength of at least 4.5 gf/D, a knot tensile strength of at least 3.5 gf/D and a roundness in the range of from 97 to 100%, which comprises:

(a) melting a polyamide resin comprising a crystalline polyamide produced by polymerizing a monomer containing m-xylylenediamine as a diamine component and adipic acid as a dicarboxylic acid component (A) by the use of a single-screw or twin-screw extruder;

(b) spinning the resultant molten resin from step (a) through a spinneret of a spinning machine and discharging a spun product through a discharge port, the spinneret having a face;

(c) pulling the resultant spun product from step (b) into a coolant bath disposed beneath the face of the spinneret to produce non-oriented yarn, wherein an air layer is maintained between the discharge port of the spinning machine and the surface of the coolant bath; and (d) orienting the non-oriented yarn to a draw ratio of from 2.5 to 8.0 at a temperature of not lower than the glass transition temperature (Tg) of said crystalline polyamide and not higher than the melting point thereof, wherein the ratio of the cross-sectional area of the spinneret to the cross-sectional area of the non-oriented yarn is 1.0 to 3.0, and the temperature of the coolant bath satisfies the following relationship:

$$Tg-30 \leqq T \leqq Tg+10 \text{ (°C.)}.$$

5. The process for producing oriented polyamide fiber according to claim 4 wherein said polyamide resin comprises at least 20% by weight of the crystalline polyamide (A) and further comprises at most 80% by weight of a crystalline polyamide (B) which is other than the crystalline polyamide (A).

6. The process for producing oriented polyamide fiber according to claim 5 wherein the crystalline polyamide (B) is at least one member selected from the group consisting of polyamide 6, polyamide 66 and a copolymer of polyamide 6 component and polyamide 66 component.

7. The process for producing oriented polyamide fiber according to claim 4 wherein the distance between the discharge port of the molten resin for the spinning machine and the surface of the coolant bath for cooling the molten resin is in the range of from 10 to 150 mm.

8. The oriented polyamide fiber according to claim 3 wherein the crystalline polymer (B) is polyamide 6.

9. The oriented polyamide fiber according to claim 1 wherein the Young's modulus is at least 500 kgf/mm$^2$.

10. The oriented polyamide fiber according to claim 1 wherein the loop strength is at least 5.0 gf/D.

11. The oriented polyamide fiber according to claim 1 wherein the knot tensile strength is at least 4.0 gf/D.

12. The oriented polyamide fiber according to claim 9 wherein the loop strength is at least 5.0 gf/D.

13. The oriented polyamide fiber according to claim 12 wherein the knot tensile strength is at least 4.0 gf/D.

14. The oriented polyamide fiber according to claim 3 wherein the crystalline polymer is polyamide 6, the Young's modulus is at least 500 kgf/mm$^2$, the loop strength is at least 5.0 gf/D and the knot tensile strength is at least 4.0 gf/D.

15. An oriented polyamide fiber which comprises a crystalline polyamide produced by a process comprising:

(a) melting a crystalline polyamide resin produced by polymerizing a diamine consisting essentially of m-xylylenediamine and a dicarboxylic acid consisting essentially of adipic acid in a single-screw or twin-screw extruder;

(b) spinning the resultant molten resin from step (a) through a spinneret of a spinning machine and discharging a spun product through a discharge port, the spinneret having a face;

(c) pulling the resultant spun product from step (b) into a coolant bath disposed beneath the face of the spinneret to produce non-oriented yarn, wherein an air layer is maintained between the discharge port of the spinning machine and the surface of the coolant bath; and (d) orienting the non-oriented yarn to a draw ratio of 2.5 to 8.0 at a temperature of not lower than the glass transition temperature (Tg) of said crystalline polyamide and not higher than the melting point thereof, wherein the ratio of the cross-sectional area of the spinneret to the cross-sectional area of the non-oriented yarn is 1.4 to 3.0, and the temperature of the coolant bath satisfies the following relationship:

$$Tg-30 \leqq T \leqq Tg+10 \text{ (°C.)},$$

said oriented polyamide fiber having a Young's modulus of at least 400 kgf/mm$^2$, a loop strength of at least 4.5 gf/D, a knot tensile strength of at least 3.5 gf/D and a roundness in the range of from 97 to 100%.

* * * * *

UNITED STATES PATENT AND TRADEMARK OFFICE

CERTIFICATE OF CORRECTION

PATENT NO. : 5,882,793
DATED : March 16, 1999
INVENTOR(S) : Takatoshi Shida et al.

It is certified that error appears in the above-identified patent and that said Letters Patent is hereby corrected as shown below:

Title page,
Item [56], References Cited, under "U.S. PATENT DOCUMENTS", replace "3,624,565 11/1971" with -- 3,642,565 2/1972 --.

Signed and Sealed this

Second Day of April, 2002

*Attest:*

*Attesting Officer*

JAMES E. ROGAN
*Director of the United States Patent and Trademark Office*